United States Patent [19]

Ishizawa et al.

[11] Patent Number: 4,726,637

[45] Date of Patent: Feb. 23, 1988

[54] DOOR SUPPORT DEVICES FOR CUPBOARDS

[75] Inventors: Kenji Ishizawa, Kyoto; Chiyokazu Higashi, Saitama, both of Japan

[73] Assignees: Daiken Trade & Industry Co. Ltd., Toyama; Murakoshi Screw Mfg. Co. Ltd., Tokyo, both of Japan

[21] Appl. No.: 857,300

[22] Filed: Apr. 30, 1986

[30] Foreign Application Priority Data

May 2, 1985 [JP] Japan ..... 60-94995

[51] Int. Cl.[4] ..... A47B 61/00

[52] U.S. Cl. ..... 312/324; 160/199; 160/206

[58] Field of Search ..... 312/324–327, 312/296, 138 R; 160/199, 206

[56] References Cited

U.S. PATENT DOCUMENTS

| | | | |
|---|---|---|---|
| Re. 27,066 | 1/1967 | Williams | 160/199 |
| 746,758 | 12/1903 | Stiggleman | 160/206 |
| 4,516,813 | 5/1985 | Sekerich | 312/323 |

OTHER PUBLICATIONS

Extract of Brochure by Häfele Illustrating Door Mounting Assemblies.

*Primary Examiner*—Joseph Falk

*Attorney, Agent, or Firm*—Leydig, Voit & Mayer

[57] ABSTRACT

A wardrobe or other container has a body and at least one pair of doors arranged to move outwardly away from an access opening to the container. This motion is permitted by mounting means which include support rollers to carry the weight of the doors and guide rollers rotatable about vertical axes and engaged in channels mounted adjacent the upper and lower edges of the container.

4 Claims, 8 Drawing Figures

DOOR SUPPORT DEVICES FOR CUPBOARDS

BACKGROUND OF THE INVENTION

1. Field of the Invention

This invention relates to hinge assemblies or other door or closure support devices for use with wardrobes, cupboards and the like.

2. Summary of the Prior Art

In case of a conventional wardrobe, cupboard or the like which is provided with a pair of foldably coupled doors for the front opening portion or closure of the main containing body thereof, normally facing rails are provided on the upper and lower sides of the open front portion of the main containing body, while on the other hand, runners are provided in the upper and lower end portions of the door bodies in a state fitted into said rails, so that said door bodies are held slidably along the open front portion of said main containing body, thus allowing the door bodies to be opened and closed.

For wardrobes, the door bodies are slid under application of the entire load thereof along the rails and runners, so that they are liable to break. If one or both of the upper and lower portions of the front opening of the wardrobe are deformed, the door bodies do not slide smoothly. Further, when the door or doors are to be mounted to or demounted from the main part of the wardrobe, it is necessary to fit the runners in the rails for performing the mounting or demounting work; and thus, in case said door is large in size, the workability becomes particular poor. In addition, such conventional wardrobes are unsatisfactory in that a clearance tends to occur between the door bodies and the front edge portion of the main wordrobe shell, thus allowing the mounting means to be exposed.

It is an object of the present invention to provide a door support device for a wardrobe or other container constructed such that the door bodies can slide smoothly, the mounting and demounting thereof can be easily performed, and in addition, the appearance of the equipment is improved.

SUMMARY OF THE INVENTION

According to the present invention there is provided in a container having at least one pair of doors for closing off an access opening thereof, a main body of the container defining the access opening which is bounded by an upper portion, and a lower portion, a support assembly for the doors comprising an upper rail mounted on said upper portion of the main body and enabling linear and pivotal motion of the doors, said rail including a guide portion of substantially U-section, a lower rail mounted on said lower portion of the main body and enabling linear and pivotal motion of the doors, said lower rail including a guide portion of inverted substantially U-section, upper motion-enabling means secured to each of said doors and incorporating rollers rotatable about vertical axes engaging in the guide portion of the upper rail for motion relative thereto, support rollers rotatable about horizontal axes by which at least a part of the weight of the doors is transferred to the said upper portion of the main body, the rollers rotatable about vertical axes serving to ensure that the support rollers follow a rectilinear path when in motion, shaft means carrying the rollers rotatable about vertical axes, mounting plates secured to each of said doors and links interconnecting the mounting plates and the main body through the upper motion-enabling means so that the doors can pivot relative to the main body, lower motion-enabling means secured to each of said doors and incorporating rollers rotatable about vertical axes engaging in the guide portion of the lower rail for motion relative thereto and serving to ensure that the lower motion-enabling means follow a rectilinear path during motion of such means, shaft means carrying the rollers rotatable about vertical axes, spring means acting on the rollers rotatable about vertical axes enabling motion of the rollers upwardly and downwardly, mounting plates secured to respective said doors, and links interconnecting the mounting plates and the main body through the lower motion-enabling means so that the doors can pivot relative to the main body to open and close the door relative to the main body, and hinge means interconnecting the pair of doors at their adjacent edges so that the doors can pivot relatively to one another and thereby extend outwardly relative to the main body to enable the access opening to be exposed.

BRIEF DESCRIPTION OF THE DRAWINGS

FIG. 3' is a section showing in detail, a screwed shaft portion of an upper part of the support assembly;

Figure 1:
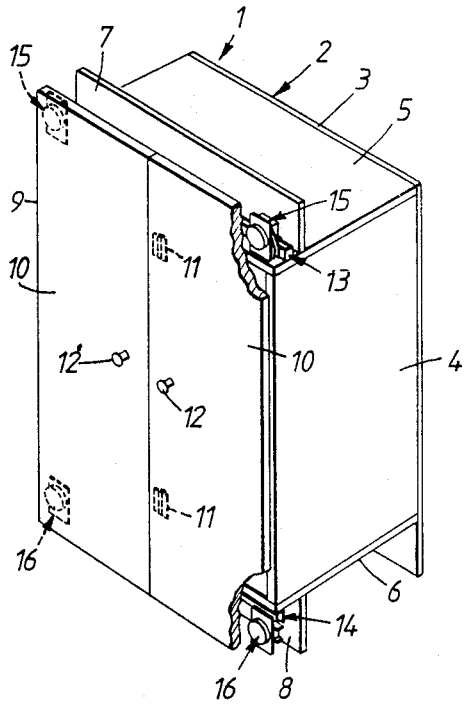
FIG. 1 is a partially cut-away, perspective view showing one embodiment of a wardrobe or other furniture item to which a support assembly in accordance with the present invention can be applied.

A door support assembly for a wardrobe or other container or furniture item will now be described in outline and comprises a main body 2 having an open front, upper and lower rails 13 and 14 mounted along the upper and lower portions of the structure defining the front opening of the main body and doors 10 or other closure members disposed at the front opening of said main body 2.

Upper and lower motion-enabling means 15 and 16 are mounted in upper and lower portions of the inwardly-directed face of the doors 10 and are movably engaged with the upper and lower rails 13,14 respectively, and pivotally support the doors 10 so that the doors 10 can be opened so as to fold with the mutually-coupled inner-edge portions thereof extending outwardly from the main body 2.

The upper rail 13 has a guide portion 22 which is approximately U-section; the lower rail 14 has a guide portion 23 which is approximately of inverted-U-section. The upper motion-enabling means 15 are each made such that support rollers 28 rotatable about horizontal axes are in contact with the upper surface of the main body 2 and horizontal rollers 31 rotatable about vertical axes are engaged in the U-section guide portion 22 of the upper rail 13 and are shaft-supported. A mounting plate 37 attached to the door 10 is pivotally mounted by links 36, and the lower motion-enabling means 16 are each constructed such that horizontal rollers 50 (rotatable about vertical axes) are engaged in the inverted-U-section guide portion 23 of the lower rail 14 and are shaft-supported so as to be movable up and down under the influence of springs 48, respectively, and further, a mounting plate 53 mounted in the door body 10 is pivotally mounted by links 52.

The door support assembly for a wardrobe or like container is so mounted that the support rollers 28 and the horizontal rollers 31 of the upper motion-enabling means already attached to the doors are brought into engagement with the upper rail from above, and thereafter, the horizontal rollers 50 of the lower motion-enabling means already attached to the doors are brought into engagement with the lower rail from below.

Figure 2:
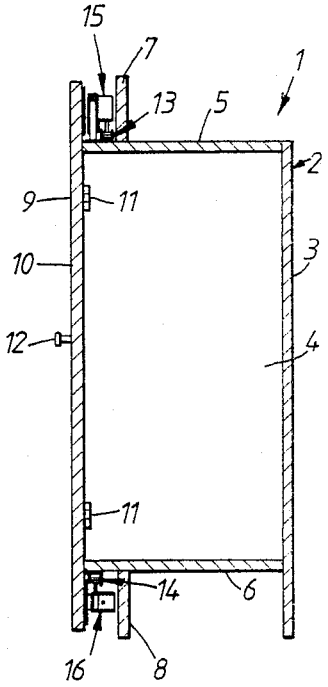
FIG. 2 is a vertical section through the furniture of FIG. 1.

Having outlined the main components of the support assembly, one embodiment will now be described in greater detail with reference to FIGS. 1 and 2. The main body 2 of the wardrobe comprises a back panel 3, two side panels 4, a top panel 5, and a bottom panel 6. Edge rails 7 and 8 are provided at positions spaced back from the front edges of said top and bottom panels 5 and 6.

For the open front of the main body 2, a folding door 9 is provided. The door 9 comprises a pair of right and left doors 10, which are coupled together by means of hinges 11 provided at upper and lower positions on the rear surfaces of the mutually adjacent inner edge portions of said doors 10 so that the pair of doors are folded, by pivotal movement, with the thus hinge-coupled inner-edge portions thereof extending outwardly away from body 2, thus exposing the open front of the main body 2. Door knobs 12 are provided on the front surfaces of the doors 10 at positions adjacent to the hinge-coupled inner-edge portions thereof.

Figure 3:
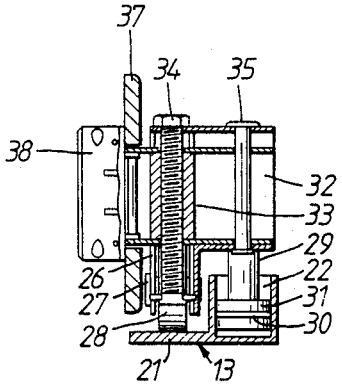
FIG. 3 is a section to an enlarged scale of a part of the support assembly shown in FIG. 2.
Figure 3:
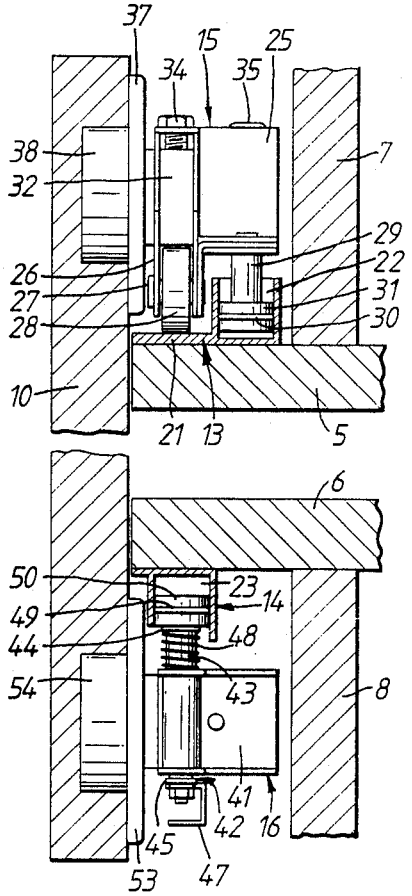
Figure 6:
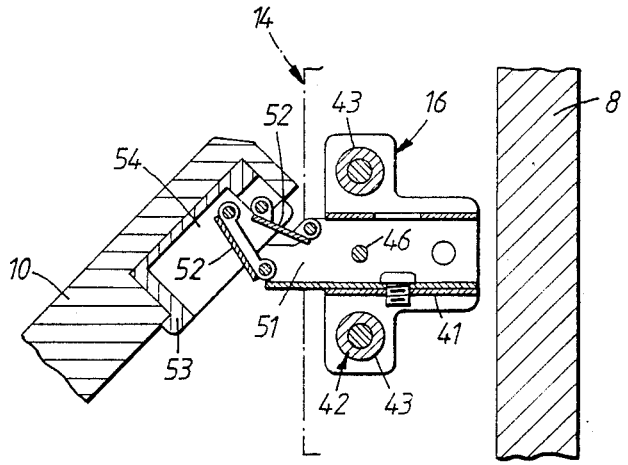

The upper and lower rails 13 and 14 and the motion-enabling means 15 and 16 will be described in more detail by referring to FIGS. 3 and 6.

The upper rail 13 is mounted along the front edge portion of the upper surface of the top panel 5 and comprises a front portion, i.e. a horizontal guide portion 21 and the rear portion, i.e. the guide portion 22.

The lower rail 14 is mounted along the front edge portion of the lower surface of the bottom panel 6 and comprises the guide portion 23.

Figure 5:
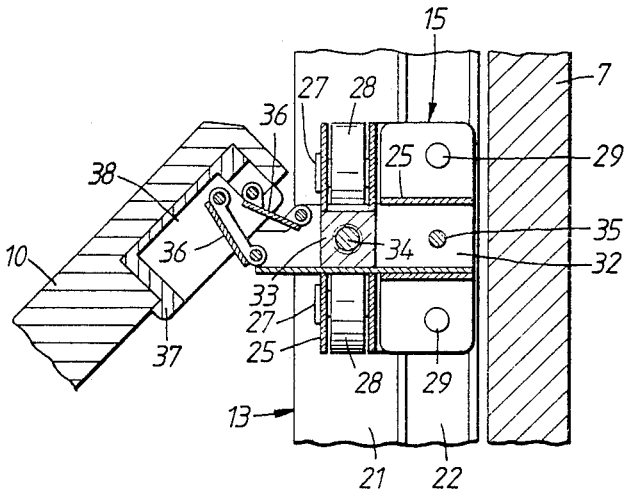
FIGS. 5 and 6 are cross-sectional views of the upper and lower parts of FIG. 3.

The upper motion-enabling means 15 are each so constructed that support rollers 28 are respectively supported by shafts 27 through bearing plates 26 in the lower part on both sides of the front portion of a frame body 25, and further, the horizontal rollers 31 which each have a resilient annular body 30 surrounding the periphery of each roller 31 are supported by vertical shafts 29 in the lower parts on both sides of the rear portion of the frame body 25. In the center portion of the frame body 25, a support frame 32 is fitted so as to be movable up and down, and, in approximately the center of the support frame 32, an internally screw-threaded body 33 is fitted, with which a screwed shaft 34 extending vertically in the front portion of the frame body 25 is engaged, and further, in the rear portion of the support frame 32, a guide rod 35 is inserted which extends vertically through the rear portion of the frame body 25. Furthermore, the pair of links 36 are each pivotally mounted at one end thereof to the front end portion of the support frame 32, and, to the other ends of the links 36, a mounting plate 37 is attached so as to be pivotal in a cup portion 38 thereof. One of the links 36 (uppermost in FIG. 5) has a pin which is movable in slots formed in the wall of the mounting plate 37 thus providing guidance and limiting the motion of the associated door 10.

The mounting plate 37 of each upper motion-enabling means 15 is secured to the door 10 by mounting screws 39 with the cup portion 38 thereof embedded in the door 10, in which case the support rollers 28 are supported on the guide portion 21 of the upper rail 13, and the horizontal rollers 31 are engaged in the guide portion 22.

Figure 4:
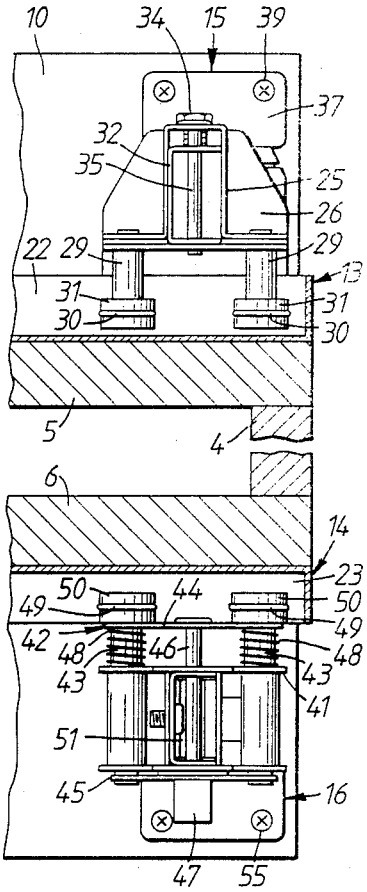
FIG. 4 is a part sectional rear view of FIG. 3.

The lower motion-enabling means 16 are each constructed as follows: In the front portion of a frame body 41 (FIG.4), a movable frame 42 is provided so as to be movable up and down. This movable frame 42 comprises guide rods 43 which are fitted into both side portions of the frame body 41 so as to be movable up and down, connecting plates 44 and 45 which extend span between the upper ends of the guide rods 43 and also the lower ends of said guide rods 43, an operating rod 46 which is coupled with the center portions of the connecting plates 44 and 45, extending through the frame body 41, and a knob 47 which is attached to a downwardly extending portion of the operating rod 46. Further, around those portions of the two guide rods 43 which extend between the upper surface of said frame body 41 and the lower surface of the upper connecting plate 44, coil springs 48 are mounted, respectively, so that the movable frame 42 is constantly urged upwardly.

Horizontal rollers 50 each having a resilient annular body 49 disposed around the periphery thereof are supported on the upper end portion of the two guide rods 43. Further, a support frame 51 is mounted in the center portion of the frame body 41, and, to the front end portion of the support frame 51, ends of a pair of links 52 are pivoted, while, at the other ends of the links 52, a mounting plate 53 is secured so as to be pivotal in a cup portion 54 of the mounting plate 53.

The mounting plate 53 is secured to the door 10 by mounting screws 55 with the cup portion 54 thereof embedded in the door 10, and the horizontal rollers 50 are engaged in the guide portion 23 of the lower rail 14.

The pair of doors 10 is then mounted on to the main body 2 as follows: The upper motion-enabling means 15 of the respective doors 10 is disposed on the rail 13 so that the support rollers 28 are brought into contact with the guide portion 21, while the horizontal rollers 31 are inserted into the guide portion 22.

Then, the horizontal rollers 50 of the lower motion-enabling means 16 are pulled down by means of the knob 47 of the movable frame 42 on the lower motion-enabling means 16, and, in this state, the horizontal rollers 50 are positioned below the guide portion 23 of the lower rail 14. The movable frame 42 is then pulled down until it is released so that the horizontal rollers 50 are allowed to return upwardly together with the movable frame 42 by the force of the springs 48, so that the horizontal rollers 50 are inserted into the guide portion 23.

Then, if the knob 12 on one of the two doors 10 is pulled by the user in one direction, the doors 10 are pulled together so as to fold in the direction of the pull, turning outwardly through the links 36 and 52 of the upper and lower motion-enabling means 15 and 16, so that the hinge-coupled inner-end portions of the doors 10 extend outwardly from the body 2 in a folded manner, thus exposing the open front of the main body 2.

If, with the doors 10 thus opened, the knob 12 of the other door 10 is pulled in the opposite direction, then the doors 10 are pivotally moved in the closing direction, thus covering the open front of the body 2.

When mounting the pair of doors 10, the screw shaft 34 of each upper motion-enabling means 15 is rotated so that, through the internally threaded body 33, the support frame 32 is moved up or down, so that the effective height and position of the doors 10 is adjusted. In this connection, the screw 34 is best shown in FIG. 3'.

The guide portion 21 of the upper rail 13 need not necessarily be made integral with the guide portion 22; and the support rollers 28 can be mounted directly on the top panel 5.

Furthermore, although, at the respective ends of the upper and lower rails 13 and 14, stops are provided for preventing the motion-enabling means 15 and 16 from falling off, the stops may be made in the form of projections provided on the top panel 5.

Furthermore, in the herein described embodiment, the main body is box-shaped, but the assembly can also be applied to, e.g. a wall-closet formed such that the doors are mounted at the open front of a main body comprising a recess made in a wall of a building, in which case, however, the upper and lower rails 13 and 14 are disposed on the support frame fixed in the recessed wall portion instead of the top panel 5 and the bottom panel 6.

The main body is covered by a pair of doors, but two or more pairs of such doors can be mounted side by side in case of a particularly wide container. In such case, the doors can be freely moved right and left, and therefore, the container is particularly suitable for insertion and removal of elongate items. The manner in which the doors can hinge and move rectilinearly is fully apparent from FIG. 7. The two pairs of doors illustrated can hinge relative to one another individually and the pairs of doors can be rolled along the rails thus defining a wide range of different openings as required.

Figure 7:
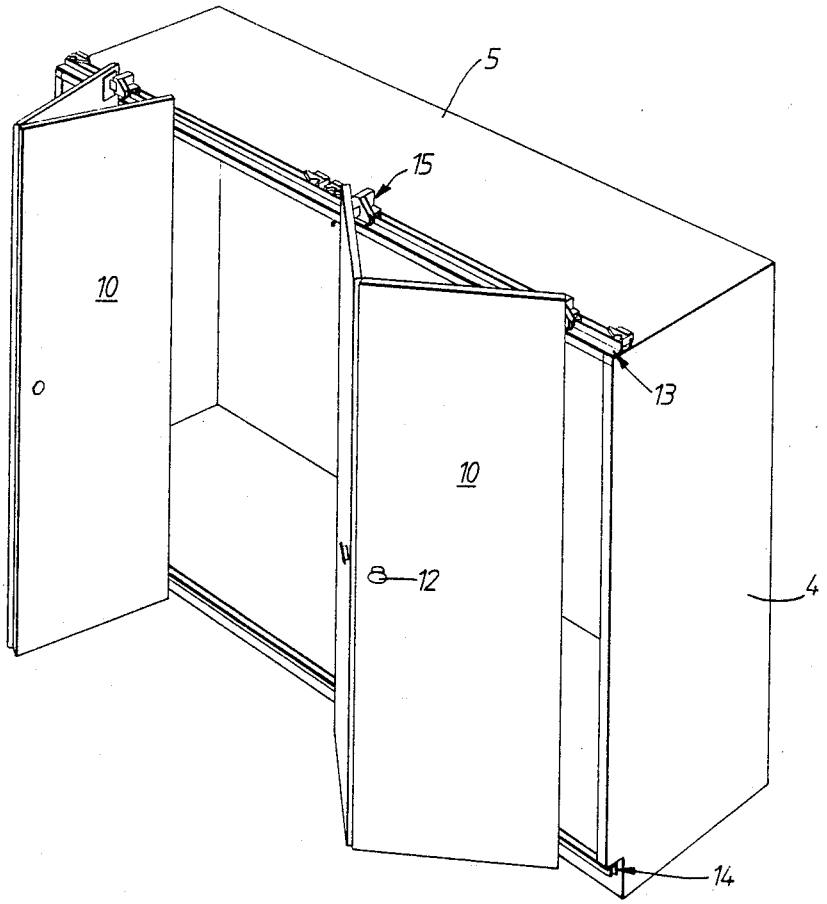
FIG. 7 is a perspective view of a wardrobe equipped with two pairs of doors and showing the respective pairs in different, folded, orientations.

As shown in FIG. 7 two or more pairs of doors can be pivotally coupled together by means of hinges. A folding door according to the present invention can thus be rendered into a structure consisting of more than two pairs of doors, four for example.

The present invention can be applied to containers so that one of the paired doors is pivotally attached to a side panel of the main body by means of hinges, and a door support assembly according to the present invention is provided at the outer side end of the other door.

The support rollers and the horizontal rollers of the upper motion-enabling means mounted on the doors are brought into engagement with the upper rail from above and, thereafter, the horizontal rollers of the lower motion-enabling means mounted on the doors are brought into engagement with the lower rail from below, as a result of which the doors are moved with the load thereof applied to the main body. The assembly according to the present invention has excellent durability, and the doors can be easily mounted on to the main body. The horizontal rollers of the lower motion-enabling means can be demounted from the lower rail against the spring load applied to the horizontal rollers, and the support and horizontal rollers of the upper motion-enabling means are detached from the upper rail by moving the doors upwardly. The mounting and demounting of the doors can thus be easily performed. In addition, since the lower motion-enabling means are freely movable up and down, the doors can run smoothly even if the upper and/or lower portions of the structure defining the open front of the main body are somewhat deformed.

Furthermore, when opening or closing the doors, they are turned by the links, and therefore, it is ensured that the doors can be smoothly opened or closed without being brought into contact with the main body side. When closed, the doors come into close contact with the main body side. Since the upper and lower motion-enabling means are positioned on the inner side of the doors, they are not visible from outside, thus maintaining the appearance of the wardrobe or other item incorporating the doors. Attention is drawn to co-pending application No. 886,354 in the name of Ishizawa and Higashi filed July 17, 1986. This application relates to subject matter concerning details of the support devices for doors of a wardrobe or other container, such devices being alternative and/or complementary to devices disclosed in the present application.

What is claimed is:

1. In a container having at least one pair of doors for closing off an access opening thereof, a main body of the container defining the access opening having two vertical boundaries and an upper and lower boundary, which is bounded by
an upper portion, and
a lower portion each said door having an upper and a lower edge and two vertical edges, one of the vertical edges of each door being, in the closed configuration of the doors, adjacent to one of the vertical boundaries of the access opening, a support assembly for the doors comprising an upper rail mounted on said upper portion of the main body and enabling linear and pivotal motion of the doors, said rail including
a guide portion of substantially U-section, upper motion-enabling means secured to each of said doors at the respective upper edge of each door and adjacent the respective vertical side edge of that door, and incorporating
rollers rotatable about vertical axes engaging in the guide portion of the upper rail for motion relative thereto,
support rollers rotatable about horizontal axes by which at least a part of the weight of the doors is transferred to the said upper portion of the main body, the rollers rotatable about vertical axes serving to ensure that the support rollers follow a rectilinear path when in motion,
shaft means carrying the rollers rotatable about vertical axes,
mounting plates secured to each of said doors and
links interconnecting the mounting plates and the main body through the upper motion-enabling means so that the doors can pivot relative to the main body, lower motion-enabling means secured to each of said doors at the respective lower edge of each door and adjacent the respective vertical side edge of that door, and incorporating,
rollers rotatable about vertical axes engaging in the guide portion of the lower rail for motion relative thereto and serving to ensure that the lower motion-enabling means follow a rectilinear path during motion of such means,
shaft means carrying the rollers rotatable about vertical axes, spring means acting on the rollers rotatable about vertical axes enabling motion of the rollers upwardly and downwardly, mounting plates secured to respective said doors, and links interconnecting the mounting plates and the main body through the lower motion-enabling means so that the doors can pivot relative to the main body to open and close the door relative to the main body, and hinge means interconnecting the pair of doors at their adjacent edges so that the doors can pivot relatively to one another and thereby extend outwardly relative to the main body to enable the access opening to be exposed.

2. A container according to claim 1, wherein the support rollers rotatable about horizontal axes are adapted to run along a plane portion of the upper rail.

3. A container according to claim 2, comprising adjustable mounting means of the rollers rotatable about horizontal axes.

4. A container according to claim 1, wherein the rollers rotatable about vertical axes each has a resilient annular body disposed around the periphery thereof.

* * * * *